United States Patent [19]

MacCarthy

[11] Patent Number: 4,492,057

[45] Date of Patent: Jan. 8, 1985

[54] YO-YO WITH NON-CIRCULAR CROSS-SECTIONAL AXLE

[76] Inventor: Patrick MacCarthy, 37 Mines Park, Golden, Colo. 80401

[21] Appl. No.: 413,119

[22] Filed: Aug. 30, 1982

Related U.S. Application Data

[63] Continuation-in-part of Ser. No. 298,720, Sep. 2, 1981, Pat. No. 4,442,625, which is a continuation-in-part of Ser. No. 138,729, Apr. 8, 1980, Pat. No. 4,290,224, and a continuation-in-part of Ser. No. 293,797, Aug. 18, 1981, Pat. No. 4,437,261.

[51] Int. Cl.[3] ..... A63H 27/12

[52] U.S. Cl. ..... 446/250

[58] Field of Search ..... 46/61, 64, 67, 70, 71

[56] References Cited

U.S. PATENT DOCUMENTS

| | | | |
|---|---|---|---|
| 864,214 | 8/1907 | Temple | 46/61 |
| 3,858,348 | 1/1975 | Brown | 46/61 |
| 4,290,224 | 9/1981 | MacCarthy | 46/61 |

FOREIGN PATENT DOCUMENTS

| | | | |
|---|---|---|---|
| 122037 | 3/1931 | Austria | 46/61 |
| 744245 | 1/1933 | France | 46/61 |

*Primary Examiner*—Robert A. Hafer
*Assistant Examiner*—William H. Honaker
*Attorney, Agent, or Firm*—Oblon, Fisher, Spivak, McClelland & Maier

[57] ABSTRACT

A toy capable of combined rotational motion about an axle and translational motion in a vertical direction. Two parallel discs are connected through their centers and are maintained in a spaced-apart position, by an axle. The axle is non-circular in cross-section, and is supported by a tape which is inserted along the axle's longitudinal axis between the two axle-halves. The opposite end of the tape may be attached to a swivel which is in turn connected to a holding apparatus. In order to operate the toy, the end of the tape or the holding apparatus is held in the operator's hand and a down-and-up motion is imparted to the toy. The body of the yo-yo may alternatively be suspended from a string which is firmly anchored to the axle.

8 Claims, 5 Drawing Figures

YO-YO WITH NON-CIRCULAR CROSS-SECTIONAL AXLE

CROSS REFERENCES

This application is a continuation-in-part of my copending U.S. patent application Ser. No. 298,720 entitled "TAPE-SUPPORTED SLEEPER YO-YO" filed Sept. 2, 1981 now U.S. Pat. No. 4,442,625 which is incorporated herein by reference, which is in turn a continuation-in-part of my U.S. patent application Ser. No. 138,729 filed Apr. 8, 1980 now U.S. Pat. No. 4,290,224 entitled "TAPE-SUPPORTED YO-YO" and copending application Ser. No. 293,797 filed Aug. 18, 1981 now U.S. Pat. No. 4,437,261 entitled "YO-YO WITH TWIST-RESISTANT STRING," both of which are also incorporated herein-by-reference. This application is also related to my copending PCT Application No. PCT/US81/01269 entitled "YO-YO WITH TWIST-RESISTANT SUPPORT" filed Sept. 21, 1981, and to my copending CANADIAN Application "YO-YO WITH TWIST-RESISTANT SUPPORT" filed May 25, 1982.

FIELD OF THE INVENTION

This invention relates to the field of rotating toys and particularly to tethered aerial tops. More specifically the present invention relates to a tape-supported yo-yo or a string supported yo-yo wherein the transverse cross-section of the axle in the assembled yo-yo is characterized by being non-circular.

BACKGROUND OF THE INVENTION

The body of a conventional yo-yo consists of two discs firmly connected through their centers by an axle which is centrally connected to both discs, which maintains them spaced apart and parallel to each other. A string is connected to the axle in the space between the two discs.

In one modification of the conventional yo-yo the string is looped about the axle somewhat loosely, allowing the axle, and consequently the yo-yo body as a whole, to spin or rotate within this loop of the string. This type of spinning of the yo-yo body within the loop of the string, wherein the string is not being wrapped around the axle during the spinning, is referred to as "sleeping" and is described in a British Patent to Duncan, G.B. Pat. No. 392,002 and is further described in Stivers and Ennis, U.S. Pat. No. 2,629,202, in Radovan, U.S. Pat. No. 3,717,949 and in my copending U.S. patent applications Ser. No. 293,797 entitled "YO-YO WITH TWIST-RESISTANT STRING" filed Aug. 18, 1981, and Ser. No. 298,720 entitled "TAPE-SUPPORTED SLEEPER YO-YO" filed Sept. 2, 1981.

In the other most common type of conventional yo-yo the string is firmly secured to the axle of the yo-yo body, which means that spinning of the yo-yo body must be accompanied by winding of the string about the yo-yo axle, or unwinding of the string from the yo-yo axle; this is a "non-sleeper" yo-yo.

The inventor has recently patented an unconventional yo-yo which employs more widely spaced-apart discs in association with a torsion-resistant tape or ribbon; that particular patent, U.S. Pat. No. 4,290,224, relates to a yo-yo of the non-sleeping type. This invention also relates to a non-sleeping yo-yo having a tape or a string as the support means. For description purposes, the invention will be described primarily in terms of a tape support but a string support is also within the scope of the invention.

The tape-supported yo-yo may have a swivel system and holding means such as a ring at the end opposite that attached to the axle. Basically, it is operated as follows: The tape is partially or fully wound around the yo-yo axle and the end of the tape or the holding ring is held in one hand, while the body of the yoyo is held in the other hand. The body of the yo-yo is then released and falls under the influence of gravity. However, since the tape is wrapped about the yo-yo axle, this falling translational motion must be accompained by rotation of the yo-yo body about the axis of the yo-yo as the tape unwinds from the axle. By the time the yo-yo body has reached the bottom-most part of its swing, i.e. when the tape has become fully unwound, the yo-yo body has acquired considerable angular momentum which forces it to continue rotating in the same direction, thereby causing the tape to wind about the yo-yo axle in the direction opposite to that in which it was wound previously. This causes the yo-yo body to rise up along the tape again, the distance of automatic rise being inversely dependent on the amount of rotational energy dissipated by friction between the yo-yo body and the tape, and between the yo-yo body and the air. The yo-yo body can be maintained in continuous down-and-up motion by applying a gentle upward jerk to the tape just prior to the yoyo body reaching the bottom of each swing, thereby compensating for the frictional loss of energy in the rotating yo-yo. This jerk applies a torque to the yo-yo body which increases its angular momentum.

All conventional yo-yos, both "sleepers" and "non-sleepers" employ axles of circular transverse cross-section, and it appears contrary to common sense to produce a yo-yo with anything but a circular cross-sectional axle. However, as a result of extensive experimentation with a wide variety of this type of yo-yo by the inventor, it has been discovered that those particular yo-yos having a slightly non-circular cross-sectional axle operated surprisingly more smoothly than those having an axle of circular cross-section in the assembled yo-yo. Prior to this discovery, the inventor went to a considerable effort to make yo-yos having axles which were exactly circular in cross-section; and much to his surprise those yo-yos with circular cross-sectional axles performed less smoothly than those having a noncircular axle.

DEFINITIONS

Axle—Is defined as that length of material employed to connect the discs and about which the support is wound, independent of the tape, string or other support associated therewith and/or wrapped thereabout.

Effective Axle—Is defined as the axle itself plus that amount of support wound about it at any time T. The diameter of the effective axle will be a variable quality, varying from a maximum at time $T_o$, when the support is completely wrapped about the axle to a minimum at time $T_n$ when the support has completely unwound.

Free Axle—Is defined as the axle when no support is placed between the two halves thereof, and the halves are united along their cut face. The transverse cross-section of the free axle may be circular, or may itself be non-circular. When circular, the non-circularity of the assembled axle of the complete yo-yo will be due to the support interposed between the two halves of the united free axle.

Assembled Axle—Is defined as the two halves of the axle (as divided along its longitudinal axis) with a support inserted between the two halves, the halves thereafter being joined on either side of the support. The transverse cross-section of the assembled axle must be non-circular within this invention.

SUMMARY OF THE INVENTION

The present invention is comprised of a single axle which connects two parallel discs at their centers; the axle maintains the two discs in a spaced-apart disposition. The axle is non-circular in cross-section. In a particular embodiment of the axle, it consists of two halves, being divided along its longitudinal axis. The tape is firmly attached to the axle by inserting it between the two axle halves prior to assembling the yo-yo. The tape may be firmly attached to the axle in this manner by wedging, gluing, sonic welding or by other means. A string may be attached to the yo-yo axle in a similar manner, or by inserting the string into a hole in an unsplit axle and preventing it retreating from the axle by tying a knot at its end in a manner identical to, or similar to, that described in my U.S. Pat. No. 4,290,225. Alternatively, the string may simply be securely attached to the axle by means of a slip knot or some other type of tight knot.

One explanation of the operation of a slightly non-circular axle in this type of yo-yo is given below. When the initially fully extended tape starts to wind around the axle, a slight bulge is created at the point of emergence of the tape from between the two axle-halves, where the tape bends over in order to wrap around the axle. This bulge is maintained, and persists in the same direction, as the tape continues to wind around the axle. This bulge contributes to a slight wobbliness and roughness in the "feel" of the operating yo-yo, due to the fact that the effective axle cross-section, i.e. the real axle plus the various layers of wound tape, is non-circular, and is slightly "off-center". One can compensate for, and avoid or minimize, this undesirable problem by elongating the axle diameter in a direction at right angles to the above-mentioned bulge. This elongation tends to create an additional bulge at right angles to the bulge due to the bending tape. This contributes to the tape winding in a more circular and centrally disposed manner as a whole and avoids or significantly minimizes the above-mentioned wobbliness, thereby contributing to a significantly smoother operating yo-yo. A similar effect can be used to enhance the smoothness of operation of string yo-yos when the string is securely attached to the axle in the various ways described above.

In accordance with the above-presented description of the invention, and a further description below, it is the primary object of this invention to provide a toy comprised of two discs connected in a parallel fashion through their center points by means of an axle; said axle being non-circular in transverse cross-section, and said axle connected to a support means including a tape or string support; said support means may be further attached to a swivel system and holding ring.

Another object of the present invention is to present a yo-yo possessing a smoother motion as a result of having a non-circular axle in the assembled yo-yo.

Another object of the present invention is to present a tape-supported yo-yo having a fray-resistant tape or ribbon, such as a woven-edge or selvaged ribbon.

Still another object of the present invention is to present a tape-supported yo-yo where the tape is comprised of a crease-resistant material.

Yet another object of the present invention is to present a yo-yo capable of producing sound effects by means of protruberances or bumps positioned along one or both faces of the tape.

These and other objects and advantages of the present invention will become apparent to those skilled in the art upon reading the details of construction and use as more fully set forth below, reference being made to the accompanying drawings forming a part hereof, wherein like numerals refer to corresponding points throughout.

DESCRIPTION OF THE PREFERRED EMBODIMENTS

Before the present "YO-YO WITH NON-CIRCULAR CROSS-SECTIONAL AXLE" is described in detail in terms of its preferred embodiments, it is to be understood that this invention is not limited to the particular arrangements of parts shown, as such devices may, of course, vary. It is also to be understood that the terminology used herein is for the purpose of describing particular embodiments only, and is not intended to be limiting.

Figure 1:
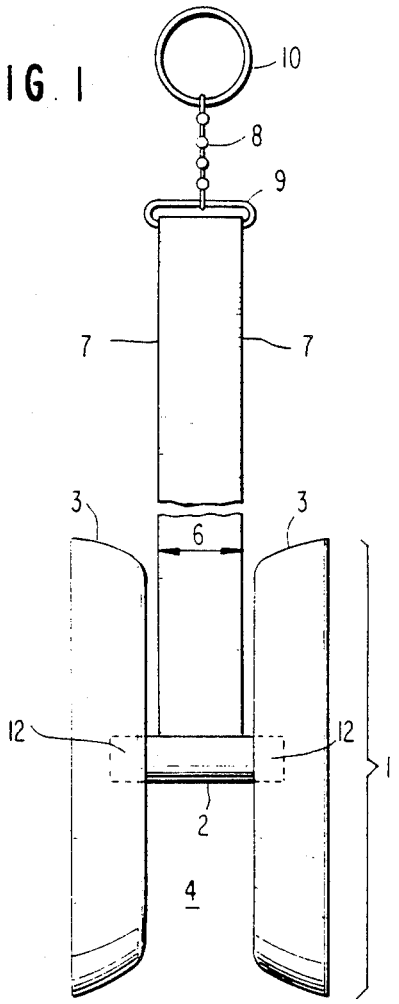
FIG. 1 is a plain front view of a tape-supported yo-yo.

Referring to the drawings, FIG. 1 shows a tape-supported yo-yo which appears similar to that in my U.S. Pat. No. 4,290,224. The body of the yo-yo is referred to generally by the number 1. The body 1 is comprised of an axle 2 which centrally connects two parallel positioned discs 3. The axle 2 is comprised of two halves 11, as illustrated in the cross-sectional view of the axle in FIG. 1. The discs 3 are separated from each other by space 4. The discs 3 may be hollow or solid and their faces may be flat or curved; these discs 3 may be of unit construction, or they may be comprised of several component parts.

An essentially flat ribbon or tape 5, of width 6, is connected at one of its ends to the axle 2, as described later. The tape 5 is connected to the axle 2 in such a manner that when the tape 5 is fully extended, the edges 7 of the tape 5 are perpendicular to the axis of axle 2. The tape 5 is connected to a swivel system 8 by a connecting means 9. The swivel 8 is also connected to a holding means which may take the form of a ring 10, or some other means of attachment to one's finger or hand. The swivel system 8 may be attached to the tape 5 by a connecting means 9 as illustrated in FIG. 1, by looping the tape through a gap in the connecting means 9 and maintaining this loop by stapling, stitching or by other means; alternatively, the swivel system 8 may be connected to the tape 5 by a connecting means which firmly clamps onto the tape.

Figure 2:
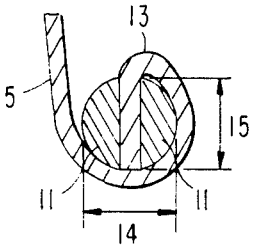
FIG. 2 is a cross-sectional view of the non-circular axle in a tape-supported yo-yo.

FIG. 2 shows a cross-sectional view of the assembled axle of this invention. In one embodiment of the invention the axle-halves 11 are maintained in close proximity by forcing the assembled axle into centrally located bores 12 in the inner walls of discs 3, as illustrated in FIG. 1. As illustrated in FIG. 2 the tape 5 is attached to the axle 2 along the longitudinal axis thereof; this is achieved by wedging the tape 5 between the two axle-halves 11, and the tape 5 is maintained in this position simply by the wedging action itself, by glue, by sonic welding, or by some other means. A bulge 13 is created where the tape 5 emerges from between the axle halves 11, as the tape 5 folds over to wrap around axle 2. This bulge 13 is maintained and persists as successive layers of tape wind upon themselves during operation of the yo-yo. As a result of this bulge, the operating yo-yo presents a slight uneveness or wobbliness in its motion which can be readily discerned by the operator.

This undesirable feel in the operating yo-yo can be minimized or eliminated by constructing the assembled axle in such a manner that diameter 14 in the assembled axle is longer than diameter 15. This effectively creates a bulge in the assembled axle at right angles to bulge 13. The net effect of both bulges is to essentially compensate for each others' effects, with the result that the yo-yo experiences a smoother motion than if diameters 14 and 15 were identical. Of course, if diameter 14 were made too large, the problem would be recreated, and unevenness in the yo-yo motion would again result. Accordingly, the excess in length of diameter 14 over diameter 15 should be just sufficient to compensate for the unevenness in the motion of the yo-yo.

If the two axle-halves 11 have semi-circular cross-sections, then the "free axle" (i.e. the two axle-halves placed together in the absence of a tape or ribbon) would provide a circular cross-section. However, in this case, the "assembled axle" (i.e. with tape or string inserted between the two axle halves) would be non-circular in cross-section due to the presence of the intervening tape or string, in which case diameter 14 would be somewhat larger than diameter 15. It has been discovered experimentally by the inventor that this slight degree of non-circularity or ellipticity is desirable and improves the performance of the yo-yo in terms of smoothness of motion.

In some cases, illustrated by an example of a preferred embodiment later, the behavior of the yo-yo can be further improved by constructing the axle-halves 11 so that the transverse cross-section to the "free-axle" (i.e. in the absence of a tape or string) is non-circular, being somewhat oblong or elliptical in configuration. Of course, this non-circularity is further enhanced in the "assembled axle" by virtue of the contribution of the thickness of the intervening tape.

All conventional commercial yo-yos invariably possess assembled axle diameters of generally circular cross-section, and consequently based on prior knowledge of this area, one of ordinary skill in the art would automatically assume that the "assembled axle" should have a circular cross-sectional axle in the yo-yos described herein. With this background, the inventor attempted to improve the performance of the tape-supported yo-yo by taking special precautions to produce a yo-yo where the "assembled axle" was exactly circular in cross-section, avoiding slight imperfections that may exist in commercial embodiments. Toward this end the inventor constructed axle-halves which were slightly less than semi-circular in cross-section (i.e. the flat faces of semi-circular axle-halves were sanded down slightly). In this case, the circumference of the "free axle" (i.e. no tape inserted) was non-circular in that the diameter parallel to the flat faces of the axle-halves was somewhat greater than the diameter orthogonal to this direction. On the other hand, the circumference of the assembled axle (i.e. with tape inserted) conformed to a circular cross-section. After constructing many such yo-yos they invariably performed in a manner inferior to those of the instant invention. The inventor found this to be a perplexing anomaly for some time until the existence of bulge 13 was realized; and later he discovered that the adverse effect of this on yo-yo performance could be compensated for by elongation of the "assembled axle" in a direction at right angles to the bulge as explained above.

It should be pointed out that the degree of non-circularity in the assembled axle of the preferred embodiment is rather small; however, this should in no way convey the impression that the effect is unimportant. For example, in a particular embodiment of the present invention containing woven-edge, grosgrain polyester ribbon the diameter 14 is 35/128 inch in length while the diameter 15 is 32/128 inch in length. The grosgrain ribbon has a thickness of about 2/128 inch which means that the axle-halves have dimensions as described in FIG. 3, where 16 is 33/256 inch and 17 is essentially ¼ inch. The surprising importance of this apparently small degree of non-circularity is illustrated by the following experiment or test which was conducted.

The inventor placed five tape-supported yo-yo's on a table, four of which had non-circular axles where the axle-halves had the dimensions specified above (33/256 inch for 16 and ¼ inch for 17), and the tape had a thickness of approximately 2/128 inch. Therefore, referring to FIG. 2, diameter 14 was 35/128 inch in length and diameter 15 was 32/128 (i.e. ¼ inch) in length. The flat faces of the axle halves in the fifth prototype were sanded down so that in the "assembled axle" diameters 14 and 15 were essentially identical in length. Six people (five adults and one child) were independently asked to operate the five yo-yos in sequence, in the absence of the other individuals, and to pick out the one(s) which was (were) least smooth in operation. In all six cases, invariably the single yo-yo which had the circular assembled axle was identified as being the least smooth, i.e. having the greatest vibration during operation; no significant differences were found among the other four yo-yo's.

Another aspect of this invention involves the use of a tape or ribbon which is resistant to fraying, particularly at the edges of the tape which may come into contact with the inner walls of the rotating discs. Woven edge or selvaged ribbons are especially effective in this regard. Furthermore the tape or ribbon should be of the crease-resistant type, i.e. the tape or ribbon should have no or minimal "memory" in that it rapidly returns to its original flat, uncreased configuration upon the release of any stress which causes it to bend, crease or wrinkle.

The inventor has also found that use of a tape or ribbon having slight protuberances or bumps along its otherwise flat surface or surfaces results in a buzzing sound during operation of the toy as the tape winds upon itself. These protuberances which may occur on one or both surfaces of the tape or ribbon may result from the actual style of weaving in a particular ribbon, or may be subsequently added by application of spots or lines of thick paint, glue or other additives at intervals along the ribbon. One type of such ribbon is available commercially (Grosgrain Reversible Polka Dot Stripe Ribbon available from C. M Offray and Son, Inc., 261 Madison Ave., New York, N.Y. 10016). By varying the spacings of these protuberances different pitch sounds may be produced; interesting sound effects may also be produced by using variable spacings of these protuberances on a given ribbon.

Figure 3:
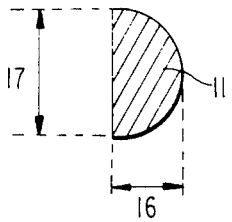
FIG. 3 illustrates a cross-sectional view of one axle-half; typical dimensions for this unit in a preferred embodiment are provided in the text.

A preferred embodiment of the present invention as illustrated in FIGS. 1, 2 and 3 consists of woven-edge, grosgrain polyester ribbon of $\frac{7}{8}$ inch width 6 and a thickness of approximately 2/128 inch. The axle-halves 11 have dimension 16 of 33/256 inch and dimension 17 of essentially $\frac{1}{4}$ inch, resulting in an "assembled axle" with dimension 14 of 35/128 inch and dimension 15 of essentially $\frac{1}{4}$ inch. The discs 3 were $2\frac{1}{4}$ inches in diameter at their widest section and consisted of plastic. The polyester ribbon was chosen because this material resists creasing. Regular fishing swivels, ball chain and bead chain have been found to work satisfactorily as the swivel means. In one embodiment, the non-circular axle conforms to an essentially elliptical shape.

Figure 4:
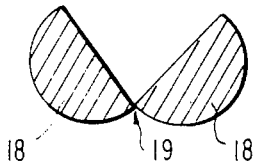
FIG. 4 illustrates an alternative embodiment of the axle where the two halves are held together in a hinge-like manner along a common edge.

In another embodiment of the invention the axle halves 18 may not be completely separable, but may be flexibly connected to each other in a hinge-like manner along a common edge 19 as indicated in the cross-sectional view of an "opened-out" configuration of the axle illustrated in FIG. 4. This axle is then closed in order to clamp the tape 5 which is secured by any of the means described previously in relation to FIG. 2.

Figure 5:
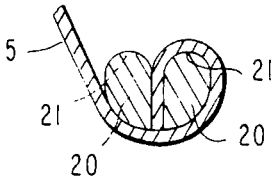
FIG. 5 shows a cross-sectional view of an alternative embodiment of an axle which tends to minimize the bulge at the point of emergence of the tape from the axle.

FIG. 5 shows a cross-sectional view of an alternative embodiment of an axle which minimizes the bulge due to the tape 5 at the point of emergence of the tape 5 from between the two axle-halves 20. In this modification the axle-halves 20 are partially cut-away or flattened at the point of emergence of the tape as indicated by the numerals 21. This design facilitates the close winding of the tape 5 about the axle, at the point of emergence of the tape 5 from between the axle-halves 20.

The instant invention is shown and described in what are considered to be practical and preferred embodiments. It is recognized, however, that departures may be made therefrom within the scope of the invention and that obvious modifications will occur to one skilled in the art.

I claim:

1. A toy capable of combined rotational motion about an axle and translational motion in a vertical direction, comprising:

an assembled axle of non-circular transverse cross-section;

a first disc connected at its center point to one end of said axle;

a second disc connected at its center point to said axle at the end opposite that whereat said first disc is attached; and a flexible torsional resistant tape one end of which is attached to said axle along the axle's longitudinal axis.

2. A toy as in claim 1, wherein said axle is elliptical in transverse cross-section.

3. A toy as in claim 1, wherein said tape consists of a fray-resistant material.

4. A toy as in claim 1 wherein said tape is a woven-edge or selvaged tape.

5. A toy as in claims 1, 3 or 4 wherein said tape is of a crease-resistant nature.

6. A toy as in claim 5, wherein said tape has a plurality of protruberences randomly positioned along one surface.

7. A toy as in claims 1, 5, or 6 wherein said tape has a plurality of protuberances positioned along one surface.

8. A toy as in claim 1, wherein the end of said support not attached to the axle is attached to a swivel device, said swivel being further attached to a means which may be held and from which the toy may be suspended.

* * * * *